United States Patent [19]

Woytek et al.

[11] 4,446,920

[45] May 8, 1984

[54] METHOD AND APPARATUS FOR PERFORATING OR CUTTING WITH A SOLID FUELED GAS MIXTURE

[75] Inventors: Andrew J. Woytek, Allentown; John T. Lileck, Tamaqua; Edward J. Steigerwalt, Lehighton, all of Pa.

[73] Assignee: Air Products and Chemicals, Inc., Allentown, Pa.

[21] Appl. No.: 457,815

[22] Filed: Jan. 13, 1983

[51] Int. Cl.[3] ..... E21B 29/02

[52] U.S. Cl. ..... 166/297; 166/300; 166/55

[58] Field of Search ..... 166/297, 298, 300, 55, 166/63; 431/91, 127, 267

[56] References Cited

U.S. PATENT DOCUMENTS

| | | | |
|---|---|---|---|
| 2,421,649 | 6/1947 | Priest et al. | 113/112 |
| 2,642,656 | 6/1953 | Grosse | 29/358 |
| 2,918,125 | 12/1959 | Sweetman | 166/297 |
| 3,066,058 | 11/1962 | Gall | 149/109 |
| 3,071,852 | 1/1963 | Rogers | 29/470 |
| 3,076,507 | 2/1963 | Sweetman | 166/297 |
| 3,128,824 | 4/1964 | Gall | 166/297 |
| 3,450,203 | 6/1969 | Patron et al. | 166/55.1 |
| 4,352,397 | 10/1982 | Christopher | 166/297 |

OTHER PUBLICATIONS

Production Operations, vol. 1, Chapter 7, Perforating Oil and Gas Wells, pp. 187–202.

*Primary Examiner*—Stephen J. Novosad
*Assistant Examiner*—William P. Neuder
*Attorney, Agent, or Firm*—Geoffrey L. Chase; E. Eugene Innis; James C. Simmons

[57] ABSTRACT

A method for cutting pipe casings and concrete liners or perforating the same and localized portions of surrounding strata in an earth bore is set forth wherein a gas phase cutting or perforating jet mixture of fluorine and nitrogen trifluoride is delivered to the cutting or perforation site from the decomposition of a solid, normally stable, perfluoroammonium salt. An appropriate apparatus for delivering the gas mixture of fluorine and nitrogen trifluoride from the salt is also disclosed.

27 Claims, 1 Drawing Figure

METHOD AND APPARATUS FOR PERFORATING OR CUTTING WITH A SOLID FUELED GAS MIXTURE

TECHNICAL FIELD

The present invention is directed to the field of downhole cutting or perforating methods for the breaching of well casing and surrounding strata in an earth bore. The invention is specifically directed to an apparatus and method for remotely perforating the metal casing, the surrounding cement and the local earth strata in a petroleum production well. The invention is also relevant to the cutting and removal of multiple stringers in sea floor petroleum recovery operations.

BACKGROUND OF THE PRIOR ART

In the production of petroleum from subterranean strata, it is often necessary to drill a well bore through several distinct areas or levels of potential petroleum production. After the exhaustion of the producing strata at the base of the well bore, it has been common practice to attempt to recover producing strata at an intermediate portion of the well bore. A problem exists in recovering an intermediate petroleum strata level because of the fact that the well bore contains a metal casing which is backed by cement or concrete. In order to recover such intermediate strata levels, it has become necessary to perforate the well casing and the concrete and surrounding strata to allow access of any liquid reserves into the well bore. The desired level of subsequent recovery at intermediate strata levels is often several thousand feet below the surface of the well head. This requires the use of remotely operated equipment which is of a sufficient compact arrangement as to be acceptably used and retrieved from the well bore.

Alternately, in the production of petroleum from offshore petroleum reserves, it is sometimes necessary to completely cut and remove stringers or pipes at the sea floor after termination of the recovery operation offshore. Cutting is also necessary to retrieve pipe and downhole tools from both land-based and offshore well bores.

Various methods and apparatus have been considered in the cutting and perforating of well casings at or below the level of the well head. These systems include the firing of bullets or slugs into the well casing, the explosion of charges which impel non-bullet masses into the well casing, the use of various chemical cutters such as fluorine and bromine trifluoride and undersea cutting torches.

The use of fluorine as an oxidizing agent for the production of a hot flame in metal cutting per se is well known in the prior art as evidenced by U.S. Pat. No. 2,421,649 wherein a cutting torch is fueled with hydrogen and fluorine.

Chlorine trifluoride is also a known oxidizer which can be used with hydrogen and hydrocarbon gases to provide a metal cutting flame as taught in U.S. Pat. No. 2,642,656.

In U.S. Pat. No. 2,918,125, the use of various fluorine compounds is set forth for the cutting of apparatus such as the wall of a well. The chemical cutting agents include fluorine and various halogen fluorides such as chlorine trifluoride, chlorine monofluoride, bromine trifluoride, bromine pentafluoride, iodine pentafluoride and iodine heptafluoride.

Other halogen fluorides are also known to be used as metal cutting agents as suggested in U.S. Pat. No. 3,066,058 wherein perhalogenyl fluoride is disclosed as a cutting or welding agent per se.

U.S. Pat. No. 3,071,852 discloses the use of nitrogen trifluoride as an oxidant to be mixed with a suitable reducing gas for a welding torch or alternately the use of nitrogen trifluoride by itself as a cutting gas per se.

The various bullet or explosive cutting and perforating methods for opening well casings are set forth in *PRODUCTION OPERATIONS,* Volume 1, Chapter 7, Perforating Oil and Gas Wells, Pages 187–202.

However, despite the numerous attempts to design a method for down-hole perforating of a well casing and the surrounding concrete and earth strata or the cutting of downhole tools and offshore stringers, various drawbacks persist such as the danger of explosion of highly reactive compounds, the misdirection and lack of penetrating power of metal slugs, and the failure of compounds such as bromine trifluoride to cut or perforate concrete and rock strata. The present invention overcomes these drawbacks by providing a safe stable chemical cutter or perforator which provides a highly reactive supply of a chemical cutter or perforator which successfully cuts or perforates metal, concrete and rock strata.

BRIEF SUMMARY OF THE INVENTION

The present invention is directed to an apparatus and a method for perforating a pipe casing, concrete and a localized portion of the surrounding strata in an earth bore or cutting of downhole tools or pipe, such as concrete coated offshore stringers, in which a highly reactive gas mixture of fluorine and nitrogen trifluoride is used to perform the perforating or cutting action wherein the gas mixture is supplied at high pressure by the rapid decomposition of a solid, normally stable, perfluoroammonium salt. The salt is preferably selected from the group comprising $NF_4SbF_6$, $N_2F_3SbF_6$, $NF_4Sb_2F_{11}$, $NF_4Sb_3F_{16}$, $NF_4BF_4$, $NF_4AsF_6$, $(NF_4)_2SnF_6$, $N_2F_3SnF_5$, $NF_4SnF_5$, $(NF_4)_2TiF_6$, $NF_4BiF_6$, $(NF_4)_2NiF_6$, $NF_4GeF_5$, $NF_4PF_6$ or other normally stable perfluoroammonium salts. Preferably the salt is $NF_4BF_4$.

Preferably, the chemical perforating or cutting gas mixture of the present invention is supplied to the cutting or perforating site by the use of a canister of the perfluoroammomium salt, which is packed with an initiator, such as aluminum powder. It is set off or decomposed into the fluorine and nitrogen trifluoride cutting gas mixture by the use of a remotely operated primer, such as an electric match. The remotely operated electric match heats a priming material which in turn combusts the initiator with the evolution of heat. The evolved heat decomposes the perfluoroammonium salt into a fluorine and nitrogen trifluoride containing gas mixture. The gas mixture, at high temperature and pressure, is then directed to the well casing where it chemically oxidizes a hole through the metal, the surrounding concrete and a localized portion of the earth strata.

Preferably, the chemical perforating method of the present invention is assisted by a hydrocarbon-containing promoter located in the apparatus or coated on the surface of the well casing, tool or stringer to be perforated or cut by the gas mixture. Suitable promoters include various hydrocarbons, particularly paraffins. They may be supported on a substrate such as stainless steel mesh.

The chemical perforating or cutting is preferably conducted at a temperature above 350° C. The pressure of the gas mixture in the perforating or cutting stage must be significantly above the pressures existing downhole or on the seafloor where the method is being practiced.

The invention is also directed to an apparatus for cutting or perforating a pipe comprising a cylindrical container, a charge of a solid, normally stable, perfluoroammonium salt, a primer for remotely igniting and decompressing the salt to a fluorine containing gas mixture, a gas pressure chamber adjacent said charge in said container for containing the released gas mixture, a frangible pressure relief disk mounted on the outlet of said chamber which is ruptured by the pressure of the gas mixture and a plurality of gas nozzles which direct the gas mixture out of the container in a manner so as to cut or perforate said pipe.

DETAILED DESCRIPTION OF THE INVENTION

Figure 1:
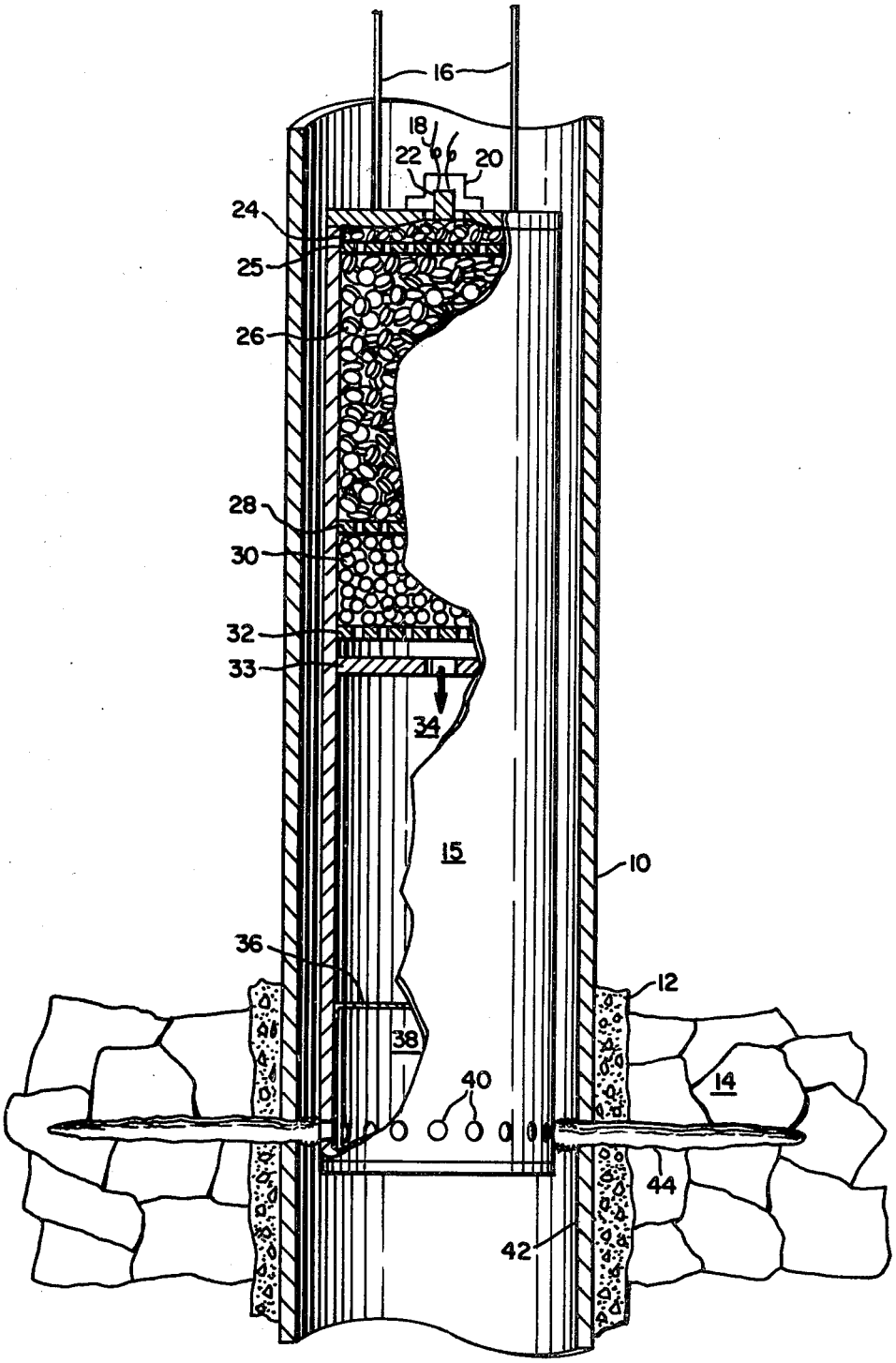
FIG. 1 shows a system in cross section for the utilization of the method of the present invention for chemically cutting or perforating as set forth in the preferred embodiment.

The present invention provides a method for chemically perforating an opening in a well casing at intermediate levels so that recovery of reserves of petroleum at various levels along a well bore may be accomplished. Alternately, the method can be utilized to completely cut pipe. In this invention, the term "perforation" is used in the context of forming a hole or holes through material such as metal pipe, concrete and rock strata. The term "cutting" is used in the context of completely severing tools, pipe or pipe and concrete combinations. It should be understood that sufficient small perforations can be made in alignment so as to effect a complete cutting. In the past, bullet perforators or explosives have been utilized in order to open the intermediate levels of well bores. However, these methods have drawbacks and are dangerous. Particularly, the penetration of not only the metal well casing, but the concrete sealant which is utilized behind the casing and a certain portion of the surrounding rock strata is necessary in order to provide the optimal access to potential petroleum reserves at intermediate levels of a well bore. The prior art concepts, at various levels of success, are able to cut or perforate the metal casing, but have generally been inadequate to cut or perforate through the concrete behind the metal casing or perforate through rock strata in the localized areas near the well bore. It is important to open fissures or perforations in the rock strata in order to get the necessary drainage of the petroleum reserve into the well bore. Some known chemical cutters, such as bromine trifluoride, will not cut the rock material around the well bore or the concrete within which the well bore casing is encased. In addition, in cutting offshore stringers, it is important to be able to cut metal pipe and the concrete or cement coating of such pipe.

The method of the present invention has been found to offer not only an improved cutting of steel and concrete, but also perforates through various compositions of rock strata. It has been found that perfluoroammonium salts are very stable at normal temperatures, but at elevated temperatures these salts decompose into highly potent gas perforating agents. The perfluoroammonium salts decompose into fluorine and nitrogen trifluoride. Both of these oxidizers have been found to provide superior cutting and perforating capability, and their admixture in a single gas phase chemical perforator has shown superior perforating and cutting capability. The perfluoroammonium salts may be selected from the group comprising $NF_4SbF_6$, $N_2F_3SbF_6$, $NF_4Sb_2F_{11}$, $NF_4Sb_3F_{16}$, $NF_4BF_4$, $NF_4AsF_6$, $(NF_4)_2SnF_6$, $N_2F_3SnF_5$, $NF_4SnF_5$, $(NF_4)_2TiF_6$, $NF_4BiF_6$, $(NF_4)_2NiF_6$, $NF_4GeF_5$, $NF_4PF_6$. Preferably, the perfluoroammonium salt would be $NF_4BF_4$ or $NF_4SbF_6$. This former compound provides one of the greatest weight percents of fluorine and nitrogen trifluoride for a given weight of solid precursor.

The perfluoroammonium salt can be loaded into a gas generating container and the container can be lowered into a stringer or a well bore at a specified depth. The gas generator container packed with a perfluoroammonium salt and preferably an initiator can then be remotely ignited by a suitable electric match and primer or other suitable means. Any primer which will attain a high temperature during ignition can be used to decompose or volatilize the solid perfluoroammonium salt and the initiator, if used. The decomposition products of the salt are a gas mixture of fluorine and nitrogen trifluoride as well as a residual gas by-product or a metal salt ash, such as metallic fluorides referred to as clinker. The evolved gas is then directed through appropriate gas channeling means to the side walls of the well casing wherein it initiates a perforation which is capable of being continued through the well casing, any concrete or cement utilized in the well casing and at least some areas of the localized rock strata beyond the well casing. Alternately, the evolved gas can cut metal pipe and concrete combinations or downhole tools if appropriate nozzle spacing is provided in the channeling means.

Preferably, as the prefluoroammonium salt decomposes, the evolved gases are contained within a limited containment area until a threshold pressure is obtained. The gases are then released at high pressure and temperature to be directed at the well casing interior wall surface or other surface to be cut or perforated.

In order to initiate a fast and efficient perforation or cut, a promoter preferably will be provided between the gas source and the metal surface in order to initiate the combustion of the fluorine and nitrogen trifluoride. This provides an initial oxidation with a sustained temperature. The sustained temperature is then sufficient to implement the reaction of the gas mixture with the metal casing. After the metal casing is at a high temperature, the reactivity of the gas mixture is sustained by the high temperature reaction of the metal and the rock components behind the metal casing. In effect, the burn or perforation with the gas mixture is sustained without the need for additional promoter after the initial temperature is obtained. It is believed that a temperature of 350° C. is necessary in order to sustain the perforating burn of the gas mixture and the well casing. However, an ambient temperature is all that is necessary in order for the gas mixture to combust with a promoter such as a hydrocarbon. Suitable promoters will include hydrocarbons and other compounds such as motor oil, vaseline, or paraffins in sufficient quantities to achieve the further reaction of fluorine and nitrogen trifluoride with the substance to be cut. The promoter can be supported on a base, such as steel wool.

A further attribute of the present invention is the fact that the fluorine active gas mixture reacts with the metal to produce a metal fluoride and with the concrete and sandstone or rock strata to produce silicon fluorides, the latter of which are gases that can be carried away from the site of the perforation. In contrast, various of the prior art perforating techniques produce liquid or solid residues which hamper the hole formation during the perforating action.

With reference to FIG. 1, the method of operation of the present invention with regard to perforation will be described in detail. However, the invention should not be construed to be limited to perforation, but also is deemed to be relevant to cutting or severing. An earth bore for petroleum recovery is shown in the drawing wherein the earth bore is aligned with a well casing 10 of suitable material such as high strength steel. The well casing 10 is backed by a layer of concrete or cement 12. This concrete or cement is utilized to seal the well casing in the earth bore. The earth bore is surrounded by various types of rock strata 14. During the course of drilling, the well bore penetrates through various strata, some of which produce petroleum at different levels. When one of the lower most producing areas is depleted, it is beneficial to produce a higher level strata from the same well. At this time, it is necessary to perforate or cut the well casing as well as the surrounding concrete and a localized portion of the rock strata. The perforation is performed by the chemical perforator shown in FIG. 1, which includes an exterior container 15 which is designed to fit inside the well bore at close tolerances. Generally, a cylindrical shaped container is contemplated. Within the container is located a charge of solid oxidizer 26 which comprises a combustible initiator such as aluminum powder and a solid, normally stable perfluoroammonium salt. The size of the charge is dependent upon the amount of burn or perforating gas necessary to perforate the casing, the concrete lining or seal and the local strata. By altering the amount of charge in the container 15, the amount of burn can be controlled and the extent of penetration into the rock strata can be predetermined. The solid oxidizer 26 charged into the container 15 is remotely set off or ignited by any relevant remote controlled primer, such as an electric match 20 which is controlled by electrical wires 18 hooked to a switching device at the well bore surface. When the chemical cutter is lowered by lines 16 into the well at the preferred site, the oxidizer 26 is set off and decomposed by the operation of the electric match 20. The match 20 ignites a primer 22, such as teflon-magnesium pellets. The primer provides the initial heat and explosion necessary to start the decomposition of the oxidizer 26. In order to assist the decomposition of the oxidizer or perfluoroammonium salt, the charged oxidizer contains a high temperature generating combustible initiator, such as aluminum powder. This combustible sustains the high temperature necessary for decomposition of the solid, normally stable perfluoroammonium salts. As the solid oxidizer 26 decomposes, a gas mixture comprising fluorine and nitrogen trifluoride evolves and passes from the solid phase into the gas phase through baffle 28. The baffle 28 insures a close packing of the oxidizer 26 so that the high temperature decomposition continues to completion. The evolved gas mixture of fluorine and nitrogen trifluoride passes through a filter 30 that entrains any solid combustion products and is accumulated in a gas pressure chamber 34. The filter 30 can consist of NaF/Monel balls or similar particulate material which is inert to the gas mixture. The close pack of the filter is maintained by a second baffle 32. The filtered gas mixture then passes through orifice plate 33 into the gas pressure chamber 34. This chamber 34 is sealed from the remainder of the container 15 by a frangible pressure relief disk 36. The pressure relief disk is designed to rupture at an optimal pressure, such that the perforating gas is released at a pressure significantly above the ambient pressure at the perforation site. This allows the chemical perforator to obtain a threshold pressure level of the perforating gas mixture before directing a jet of the gas mixture at the surfaces to be cut or perforated. As the pressure relief disk 36 is ruptured, a high pressure stream of the fluorine and nitrogen trifluoride perforating gas mixture is allowed to accumulate in the gas plenum 38, wherein it is controllably directed radially outward through a plurality of gas nozzles 40 directed at the well casing. Preferably, a promoter such as a hydrocarbon, a wax or water is coated on a stainless steel mesh located in the plenum 38. Alternately, the promoter can be coated on the surface of the well casing adjacent the output of the gas nozzles 40. In this manner, the evolving perforating gas mixture of fluorine and nitrogen trifluoride oxidizes the promoter in an exothermic reaction to provide a threshold temperature of approximately 350° C. to promote the cutting or perforating action. As the temperature at the perforating site increases, the fluorine and nitrogen trifluoride begin to cut or perforate the metal surface which is also an exothermic reaction. The exotherm then provides sufficient high temperature to sustain the burn or perforation, as long as fluorine and nitrogen trifluoride exist in the vicinity of the high temperature cutting site. This provides a good, localized containment of the desired perforation and sustains a burn front which continues in the direction of the nozzle orientation until the fluorine and nitrogen trifluoride gas mixture is fully consumed.

Although the inventors do not wish to be held to any specific theory on the cutting or perforating action, it is believed that one reason the present invention provides superior performance is that it utilizes a combination of fluorine and nitrogen trifluoride as the active composition. It is believed that the free fluorine released from the salt initiates the perforating or cutting reaction with the desired substrate and in so doing creates localized areas of significantly high temperature. The nitrogen trifluoride, although having an activity itself, is not as chemically active as the free fluorine. However, when the nitrogen trifluoride enters the high temperature site of the fluorine initiated perforation or cut, it is decomposed into additional fluorine which further enhances the perforation or cutting action. In this manner, a site selective cut or burn is achieved wherein the freshly released fluorine reacts at the high temperature site of the nitrogen trifluoride decomposition to further the initiated cut in the direction desired. This is a significant achievement over non-site specific burn techniques.

Unlike some of the prior art chemical cutters and perforators, the cutting mixture of the present invention is successful in not only perforating the metal casing, but also in perforating the concrete backing and the local portions of the rock strata surrounding the casing. This is due to the reactivity of the fluorine and nitrogen trifluoride mixture with not only metallic elements, but siliceous materials including cement, concrete and rock formations, such as sandstone and clays. This type of cutting and perforating capability is distinct from other halogen chemical cutters, such as bromine trifluoride. Therefore, in the area of concrete or rock perforating, the combination of fluorine and nitrogen trifluoride displays unexpected results. The use of such a gas mixture without derivation from solid salts, but merely from a pressurizing means as disclosed in U.S. Pat. No. 2,918,125 has been shown to effectively perforate concrete and rock.

The perfluoroammonium salts, when decomposed, generally produce a 50%/50% mixture of fluorine and nitrogen trifluoride. An experiment was run to prove the viability of such a system. The tests simulate the results which would be obtained by the decomposition of a perfluoroammonium salt to provide a mixture of fluorine and nitrogen trifluoride for perforation. A 50%/50% mixture of fluorine and nitrogen trifluoride was used to evaluate the chemical cutting power of the invention on concrete lined pipe. A vent gas accumulator was fitted with a test piece of pipe consisting of a ⅜" SCH 40 carbon steel pipe encased in ¼" of concrete. A film of hydrocarbon grease was applied to the inside of the pipe as a promoter. The vent gas accumulator was sealed, and a valve opened to allow potential reaction products of the perforation reaction to vent to a scrub system. A one liter reservoir was filled with gaseous fluorine from a cylinder supply. A total of 190 psia of fluorine was added as indicated on a pressure gauge. In a similar manner, an additional 190 psia of nitrogen trifluoride was added to the same reservoir from another cylinder to give a 50%/50% mixture at 380 psia. A valve was opened between the reservoir of the fluorine and nitrogen trifluoride gas mixture and the accumulator. The valve remained open for 8 seconds, which allowed the reservoir pressure to fall from 380 psia to 120 psia. As the valve was opened, the gas mixture flowed from the reservoir through tubing to the cutting tip of the experimental apparatus. The tip consisted of six 0.015 inch holes located around the perimeter of the cutting tip, which allowed the gas mixture to be evenly diverted perpendicularly to the surface of the test piece of concrete lined steel pipe. The gas came in contact with the inside surface of the pipe, which had been coated with the hydrocarbon promoter. During the 8 second cutting time, the skin temperature of the accumulator within which the test piece of pipe was being cut rose to a temperature of 685° F., indicating that a reaction had taken place during the perforation test. Upon subsequent cool down and disassembly of the cutting system, the pipe and the concrete lining were found to be cut through at the location of the various nozzles of the cutting tip.

In actual practice, the use of the perfluoroammonium salts to provide a mixture of fluorine and nitrogen trifluoride will be controlled by the amount of solid salt utilized in the perforation method. In using perfluoroammonium salts, it is necessary to maintain an anhydrous condition, as water is known to decompose these salts. Any water present in the supply of the salts would permit premature decomposition. The perfluoroammonium salts should also be maintained at a temperature below approximately 260° to 290° C. in order to avoid premature decomposition of the salts due to temperature. Below this temperature, the perfluoroammonium salts remain in a stable, solid configuration. The salts avoid the explosive danger of previous cutting and perforating implements for down-hole applications and provide for a unique combination of cutting gases, which are activated at the cutting site or high temperature point of reaction. The perfluoroammonium salts contain a very high percentage of fluorine in the compound. For example, a total of 88% of the weight of $NF_4BF_4$ is due to the fluorine molecule, compared to 42% for bromine trifluoride and 62% for chlorine trifluoride. When more of the fluorine is available as a reactive cutting agent, a higher reactivity for a given weight of tool is available for performing a perforation in a well bore or cutting a stringer or downhole tool. This is an important attribute in performing perforations in remote, space-limited environs, such as perforating in a well bore. The prior art has experienced problems with chemical cutters because the amount of cutting agent which is capable of being supplied to the cutting site is limited. Therefore, it is important to have a highly reactive cutting agent, such as fluorine and nitrogen trifluoride, and it is important to provide as much of that agent in a compact space as is possible. The perfluoroammonium salts provide such high concentrations of highly reactive perforating and cutting agents, as well as being significantly stable for transportation, storage and above ground utilization prior to being placed in a down-hole position and ignited by a high temperature priming device.

The present invention has been set forth in a specific preferred embodiment, however those skilled in the art will recognize other variations in the practice of the present invention. Therefore, the scope of the present invention should be ascertained from the claims which follow:

We claim:

1. A method of cutting in which a highly reactive gas mixture of fluorine and nitrogen trifluoride is used to perform the cutting action wherein the gas mixture is supplied at high pressure by the rapid decomposition of a solid, normally stable, perfluoroammonium salt.

2. The method of claim 1 wherein the cutting is performed on petroleum pipes.

3. The method of claim 1 wherein the cutting is performed on downhole tools in a well casing.

4. The method of claim 1 wherein the perfluoroammonium salt is chosen from the group comprising: $NF_4SbF_6$, $N_2F_3SbF_6$, $NF_4Sb_2F_{11}$, $NF_4Sb_3F_{16}$, $NF_4BF_4$, $NF_4AsF_6$, $(NF_4)_2SnF_6$, $N_2F_3SnF_5$, $NF_4SnF_5$, $(NF_4)_2TiF_6$, $NF_4BiF_6$, $(NF_4)_2NiF_6$, $NF_4GeF_5$, $NF_4PF_6$.

5. The method of claim 1 wherein a hydrocarbon promoter is used to promote the cutting action of the gas mixture.

6. The method of claim 1 wherein the substrate to be cut is coated with a hydrocarbon promoter prior to the initiation of the perforation action.

7. The method of claim 1 wherein the perfluoroammonium salt is decomposed by the combustion of an initiator material.

8. The method of claim 1 wherein the cutting action is performed at a temperature above 350° C.

9. The method of claim 1 wherein the fluorine and nitrogen trifluoride gas mixture is supplied to the cutting site at a pressure in excess of the ambient pressure at the cutting site.

10. The method of claim 2 wherein the pipe is in concrete or cement and the gas mixture cuts such concrete or cement.

11. The method of claim 1 wherein the perfluoroammonium salt is $NF_4BF_4$.

12. The method of claim 1 wherein the perfluoroammonium salt is $NF_4SbF_6$.

13. A method for perforating a pipe casing and a localized portion of the surrounding strata in an earth bore in which a highly reactive gas mixture of fluorine and nitrogen trifluoride is used to perform the perforating action.

14. The method of claim 13 wherein the gas mixture is supplied at high pressure by the rapid decomposition of a solid, normally stable, perfluoroammonium salt.

15. The method of claim 14 wherein the perfluoroammonium salt is chosen from the group comprising: $NF_4SbF_6$, $N_2F_3SbF_6$, $NF_4Sb_2F_{11}$, $NF_4Sb_3F_{16}$, $NF_4BF_4$, $NF_4AsF_6$, $(NF_4)_2SnF_6$, $N_2F_3SnF_5$, $NF_4SnF_5$, $(NF_4)_2TiF_6$, $NF_4BiF_6$, $(NF_4)_2NiF_6$, $NF_4GeF_5$, $NF_4PF_6$.

16. The method of claim 14 wherein a hydrocarbon promoter is used to promote the perforation.

17. The method of claim 14 wherein the pipe casing is coated with a hydrocarbon promoter prior to the initiation of the perforation action.

18. The method of claim 14 wherein the perfluoroammonium salt is decomposed by the combustion of an initiator material.

19. The method of claim 14 wherein the perforating action is performed at a temperature above 350° C.

20. The method of claim 14 wherein the fluorine and nitrogen trifluoride gas mixture is supplied to the site of perforation at a pressure in excess of the ambient pressure at the perforation site.

21. The method of claim 14 wherein the pipe casing is in concrete or cement and the gas mixture perforates such concrete or cement.

22. The method of claim 14 wherein the perfluoroammonium salt is $NF_4BF_4$.

23. The method of claim 14 wherein the perfluoroammonium salt is $NF_4SbF_6$.

24. An apparatus for cutting or perforating a pipe comprising a cylindrical container, a charge of a solid, normally stable, perfluoroammonium salt, a primer for remotely igniting and decomposing the salt to a fluorine containing gas mixture, a gas pressure chamber adjacent said charge in said container for containing the released gas mixture, a frangible pressure relief disk mounted on the outlet of said chamber which is ruptured by the pressure of the gas mixture and a plurality of gas nozzles which direct the gas mixture out of the container in a manner so as to cut or perforate said pipe.

25. The apparatus of claim 24 wherein the container is located for cutting or perforating by lines suspending the container in said pipe.

26. The apparatus of claim 24 wherein a filter is positioned in said container between the charge of a perfluoroammonium salt and said gas pressure chamber.

27. The apparatus of claim 24 wherein the charge is retained between two baffles in said container in order to retain the packing of the charge components.

* * * * *